US007984824B2

(12) United States Patent
Artsiely

(10) Patent No.: US 7,984,824 B2
(45) Date of Patent: Jul. 26, 2011

(54) SENSOR ASSEMBLY

(75) Inventor: Eyal Artsiely, Bikat Yericho (IL)

(73) Assignee: Hotel Outsource Management International, Inc., New York, NY (US)

( * ) Notice: Subject to any disclaimer, the term of this patent is extended or adjusted under 35 U.S.C. 154(b) by 572 days.

(21) Appl. No.: 12/050,189

(22) Filed: Mar. 18, 2008

(65) Prior Publication Data

US 2009/0236208 A1 Sep. 24, 2009

(51) Int. Cl.
*H01H 9/02* (2006.01)

(52) U.S. Cl. ..... 221/12

(58) Field of Classification Search ..... 221/2, 4, 221/5, 7, 9, 12, 69, 89, 90
See application file for complete search history.

(56) References Cited

U.S. PATENT DOCUMENTS

| | | | | |
|---|---|---|---|---|
| 3,381,605 | A * | 5/1968 | Smith | 99/332 |
| 3,854,022 | A * | 12/1974 | Moore | 219/704 |
| 3,940,016 | A * | 2/1976 | Krakauer | 221/129 |
| 5,454,485 | A * | 10/1995 | Dalziel | 221/83 |
| 6,198,594 | B1 * | 3/2001 | Utsumi et al. | 360/92.1 |
| 7,311,222 | B2 * | 12/2007 | Shigeyama et al. | 221/280 |
| 2007/0080166 | A1 * | 4/2007 | Alford et al. | 221/257 |
| 2010/0157003 | A1 * | 6/2010 | Edwards | 347/86 |

* cited by examiner

*Primary Examiner* — Gene Crawford
*Assistant Examiner* — Kelvin L Randall, Jr.
(74) *Attorney, Agent, or Firm* — Dekel Patent Ltd.; David Klein

(57) ABSTRACT

A sensor assembly including a sensor including an actuatable element that causes an operation when actuated by a sensor actuator, the sensor including a holder, and a biasing device that imparts a biasing force against the holder that compensates for relative movement between the actuatable element and the sensor actuator so as to maintain the actuatable element substantially at a predetermined spatial position with respect to the sensor actuator.

4 Claims, 13 Drawing Sheets

SENSOR ASSEMBLY

FIELD OF THE INVENTION

The present invention relates generally to sensor assemblies, and particularly sensors actuated by an actuator, wherein the spatial position of the actuator is critical to the proper operation of the sensor, such as but not limited to, microswitches used in vending machines for detecting purchase of items.

BACKGROUND OF THE INVENTION

Sensor assemblies, particularly microswitch assemblies, are used to sense contact of different machine parts. For example, in vending machines for vending beverage cans and the like, a microswitch is used to detect when an item is purchased from the vending machine, so that the purchaser is billed properly for the item.

These sensors thus rely on some actuator moving with respect to the sensor to cause operation of the sensor. In the case of a microswitch, for example, proper functioning of the sensor depends on some actuator striking a lever or button or some other mechanism on the microswitch. The object that strikes the microswitch must travel some distance during the striking motion and properly strike the microswitch mechanism at the end of the travel. One problem with such sensors is that in real life there are many tolerances and inaccuracies during manufacturing and use that can result in malfunctioning of the object-to-sensor strike. For example, the object may not strike the sensor enough to operate it, or worse, may not strike it at all. Alternatively, the object may overstrike the sensor, that is, strike it too hard and cause damage thereto. Alternatively, instead of the object striking the sensor, some other part may become misaligned and strike the sensor and cause false operation thereof.

SUMMARY OF THE INVENTION

The present invention seeks to provide a novel sensor assembly that overcomes the abovementioned problems of the prior art, as described more in detail hereinbelow. The sensor assembly has particular utility in vending machines, but may be used in many other machines as well.

There is thus provided in accordance with an embodiment of the invention a sensor assembly including a sensor including an actuatable element that causes an operation when actuated by a sensor actuator, the sensor including a holder, and a biasing device that imparts a biasing force against the holder that compensates for relative movement between the actuatable element and the sensor actuator so as to maintain the actuatable element substantially at a predetermined spatial position with respect to the sensor actuator.

The holder and the biasing device may be mounted on a mounting bracket. The holder may be formed with a groove and a recess adjacent the groove, and the biasing device may be placed in the recess with the mounting bracket passing through the groove. The holder may include a leading face that protects a portion of the sensor from impact applied against the leading face.

In accordance with an embodiment of the invention the sensor assembly further includes a device that includes a sensor actuator, which when in an activating position is arranged to actuate the actuatable element, wherein the biasing device maintains a substantially constant gap between the actuatable element and the sensor actuator in the activating position.

There is also provided in accordance with an embodiment of the invention a vending machine including a tray including a dispensing door openable to dispense merchandise disposed in the tray, the dispensing door being connected to a sensor actuator, a sensor including an actuatable element that causes an operation when actuated by the sensor actuator, the sensor including a holder, and a biasing device that imparts a biasing force against the holder that compensates for relative movement between the actuatable element and the sensor actuator so as to maintain the actuatable element substantially at a predetermined spatial position with respect to the sensor actuator, wherein when the tray is in an activating position, opening of the dispensing door causes the sensor actuator to actuate the actuatable element to cause the operation.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1A:
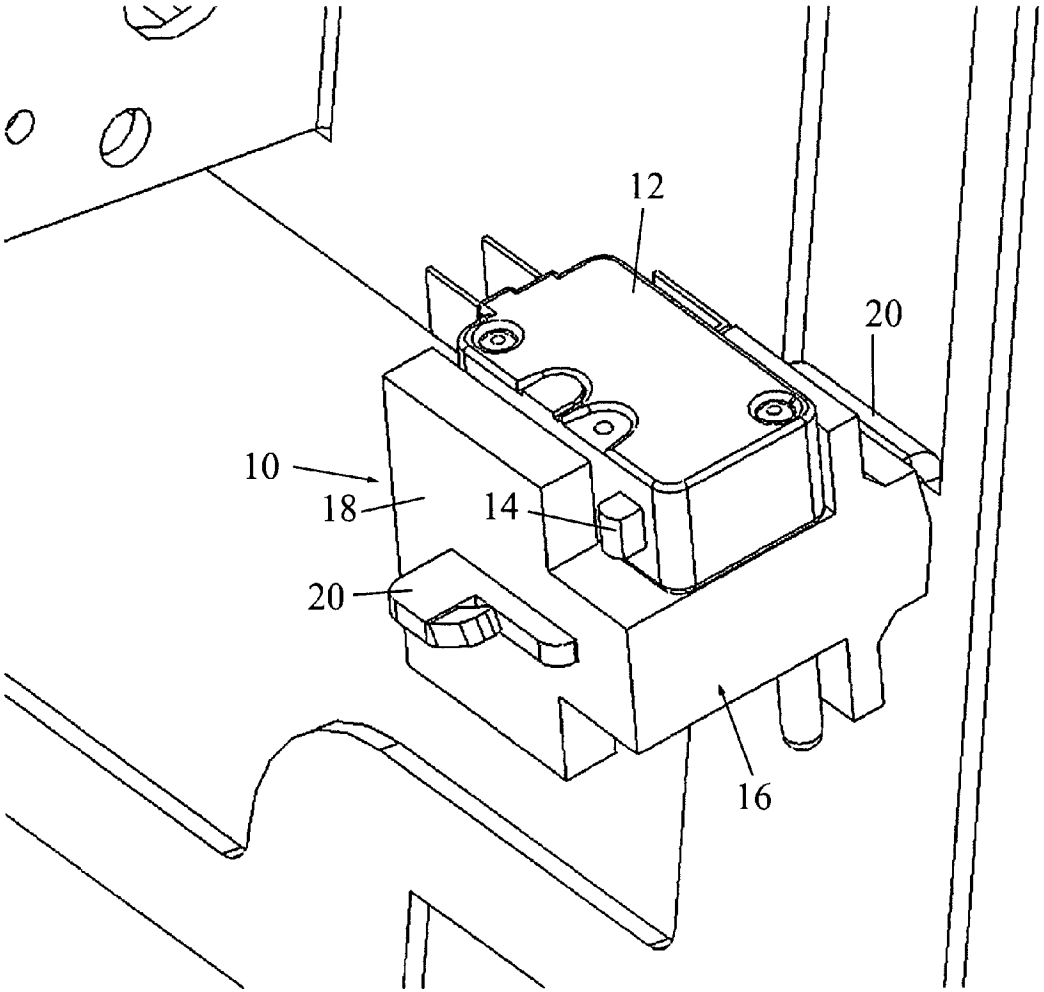
FIGS. 1A and 1B are simplified pictorial and cutaway illustrations, respectively, of a sensor assembly, constructed and operative in accordance with an embodiment of the present invention.
Figure 1B:
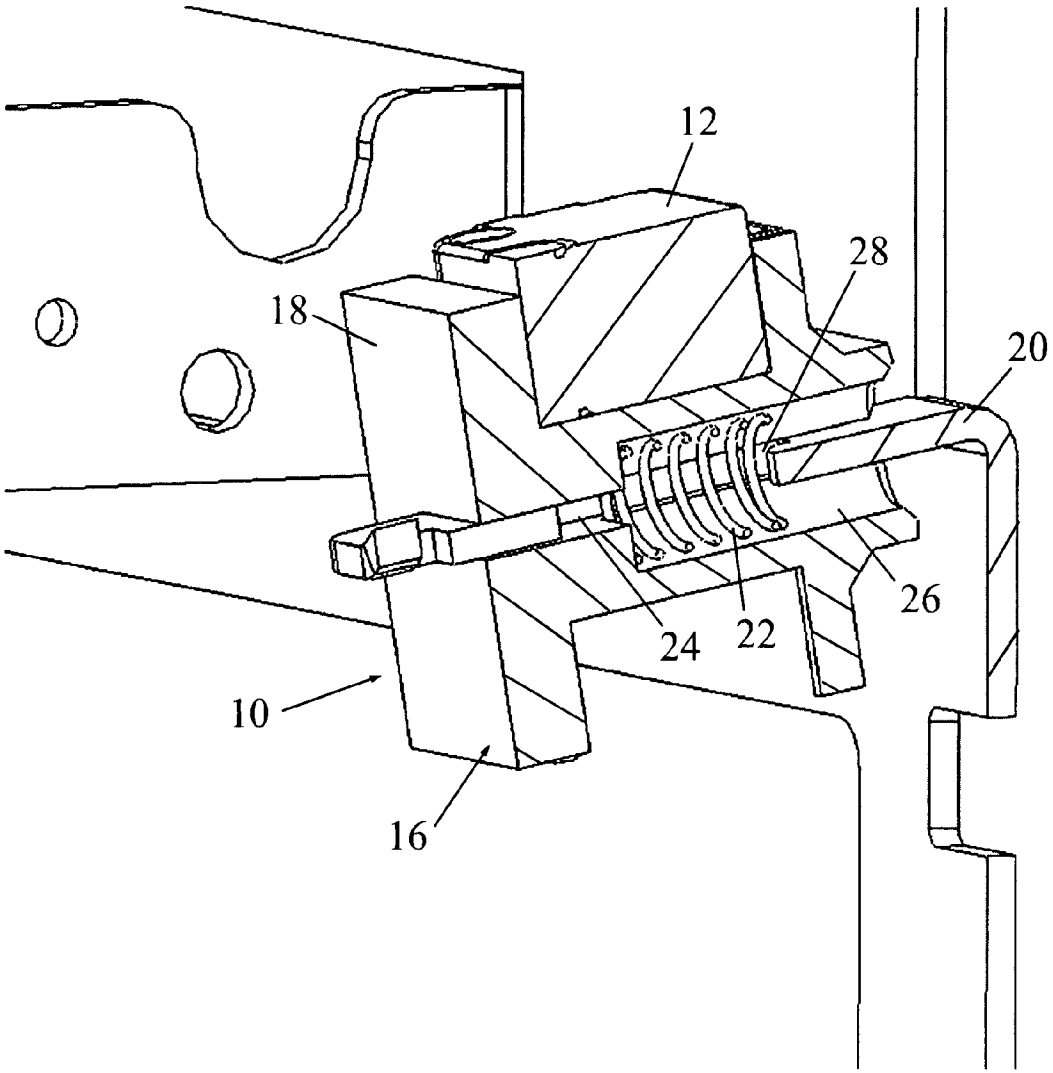

Reference is now made to FIGS. 1A-1B, which illustrate a sensor assembly 10, constructed and operative in accordance with a non-limiting embodiment of the present invention.

Sensor assembly 10 includes a sensor 12 that has an actuatable element 14. As will be described further below, actuatable element 14 is arranged to be actuated by a sensor actuator to cause an operation, such as a switching operation, and the actuatable element 14 must be substantially at a predetermined spatial position with respect to the sensor actuator in order for actuation to occur. The invention is described hereinbelow for the example of a microswitch and sensor 12 will alternatively be called microswitch 12. In the case of a microswitch, actuatable element 14 is a generic name for a button, lever, toggle or any other element that provides a switching operation when contacted with sufficient force, such as by pushing. However, it is understood that sensor 12 can be other sensors wherein the spatial position of the actuator is critical to the proper operation of the sensor. Examples include, but are not limited to, infrared sensors, photovoltaic cells or any other electromagnetic wave sensor wherein an actuator selectively blocks or does not block the path between an electromagnetic wave beam and a detector. Capacitive, inductive or magnetic proximity sensors are other examples of such sensors, wherein the actuator is an element that causes relative motion between the proximity sensor and the sensed object.

Microswitch 12 may be in electrical contact with a variety of electrical equipment or components, such as but not limited to, billing apparatus (not shown) in a vending machine.

Microswitch 12 is mounted on a holder 16 that includes a leading face 18 that protects a portion of microswitch 12 from impacts, as will become apparent further below. Holder 16 is mounted on a mounting bracket 20 by means of a biasing device 22, such as a coil spring. Other biasing devices may be used such as elastic bands, leaf springs, Belleville washers and others. In the illustrated embodiment, as seen in FIG. 1B, holder 16 is formed with a narrow groove 24 and a recess 26 adjacent groove 24. Biasing device 22 is placed in recess 26 and mounting bracket 20 passes through groove 24. Mounting bracket 20 has a cutout 28 to accommodate biasing device 22. Biasing device 22 imparts a biasing force against holder 16 in a direction towards leading face 18.

Figure 2A:
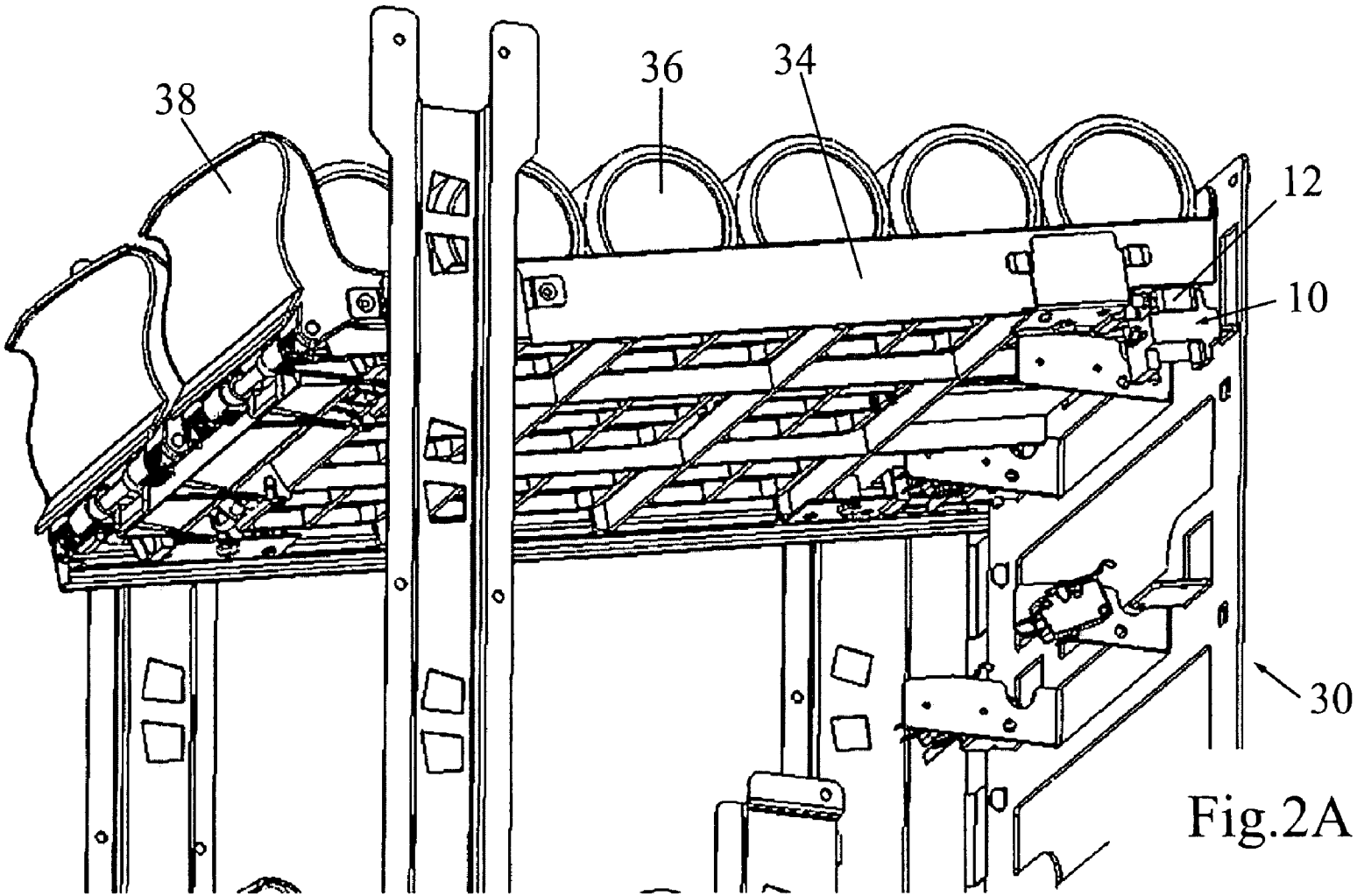
FIGS. 2A and 2B are simplified pictorial and close-up illustrations, respectively, of the sensor assembly of FIGS. 1A-1B installed in a vending machine, showing a tray of merchandise with a dispensing door closed against the merchandise and the tray closed against the sensor assembly.
Figure 2B:
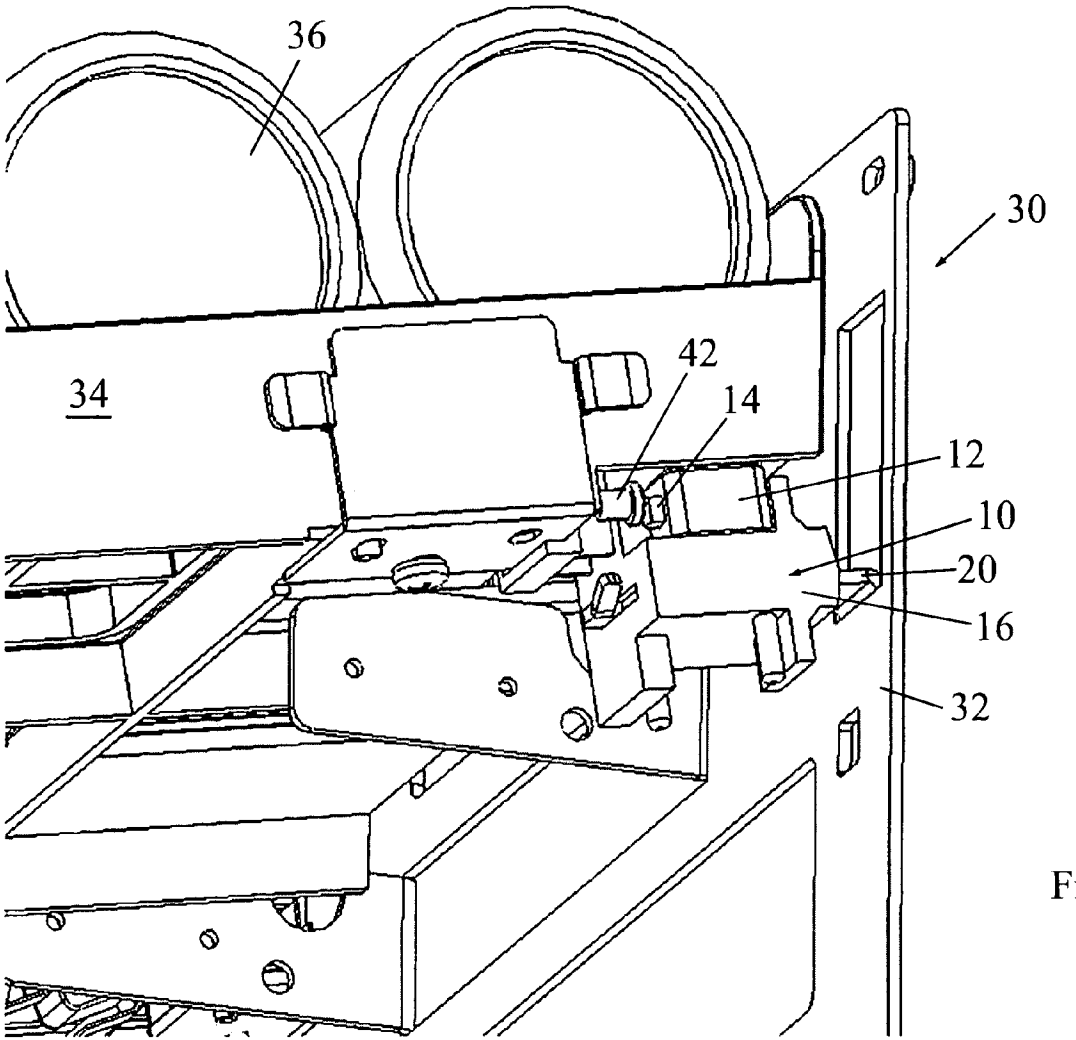

Reference is now made to FIGS. 2A and 2B, which illustrate sensor assembly 10 installed in a vending machine 30. Mounting bracket 20 may be formed by a bent latch of a backplate 32 of vending machine 30.

Figure 3:
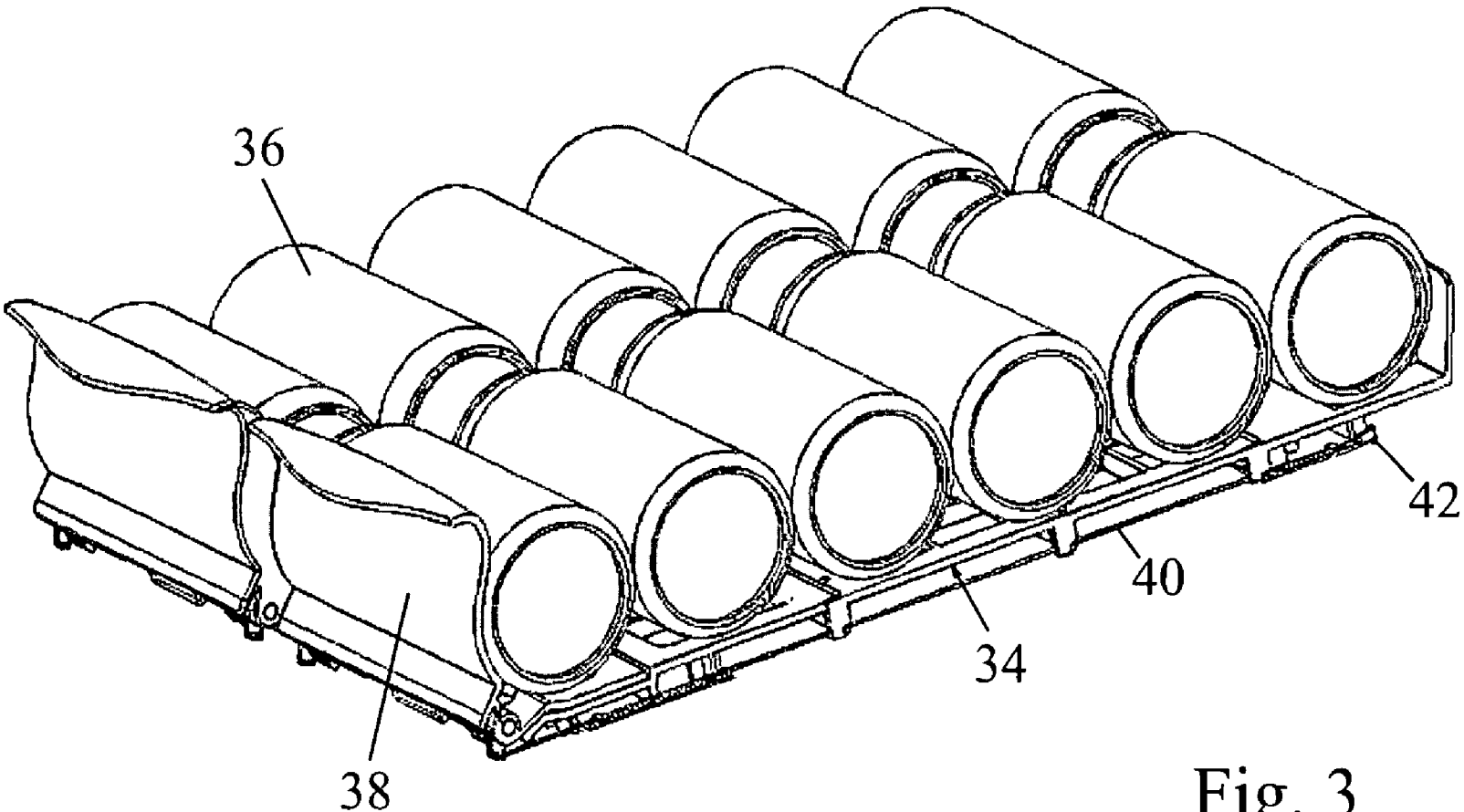
FIGS. 3 and 4 are simplified pictorial illustrations of the merchandise tray, respectively with the dispensing door closed and open to operate a push rod, in accordance with an embodiment of the present invention.
Figure 4:
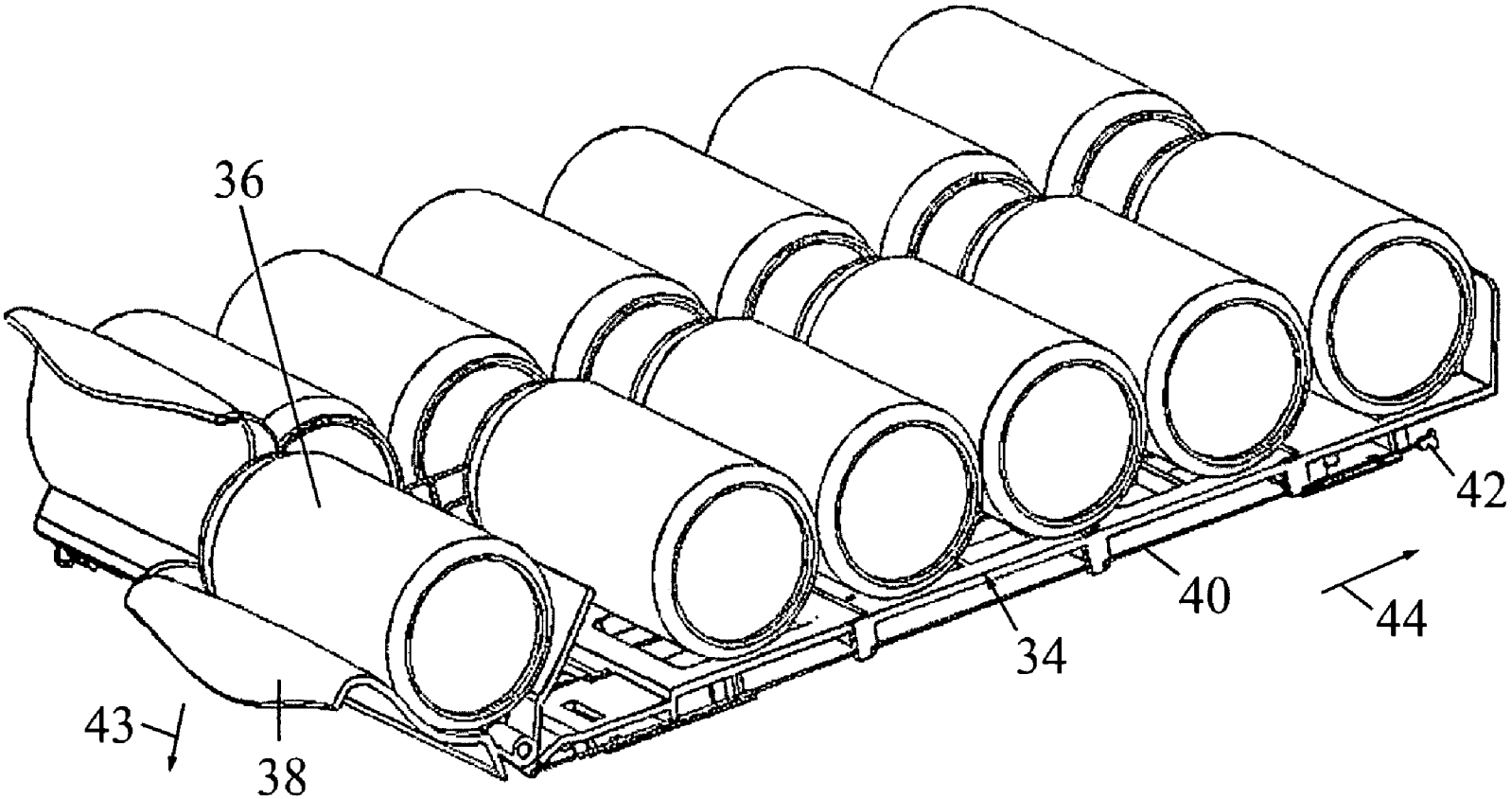

Vending machine 30 houses therein one or more trays 34 loaded with merchandise 36 (e.g., beverage cans) for dispensing thereof (these being described more in detail with reference to FIGS. 3-4). The term "tray" as used throughout the specification and claims encompasses not only a tray, but any movable element for supporting vendable items thereupon. Vending machine 30 may further include standard components of vending machines, such as but not limited to, a coin slot, a coin-operated mechanism, a lockable service door (which may be opened only by authorized personnel for replenishing the merchandise 36 in trays 34) and refrigeration apparatus, if needed (all not shown), which are well known to those skilled in the art and require no description for the skilled artisan. The coin-operated mechanism is in operative communication with a dispensing door 38 of tray 34, as is known in the art. As is known, trays 34 are preferably slanted so the merchandise 36 is urged against the dispensing door 38 by gravity and the weight of the merchandise 36. Sensor assembly 10 is mounted in the vicinity of tray 34 to sense the opening of dispensing door 38 of tray 34, as is described further below.

FIGS. 2A-2B show tray 34 with dispensing door 38 closed against the merchandise 36 and tray 34 closed against sensor assembly 10.

Figure 5A:
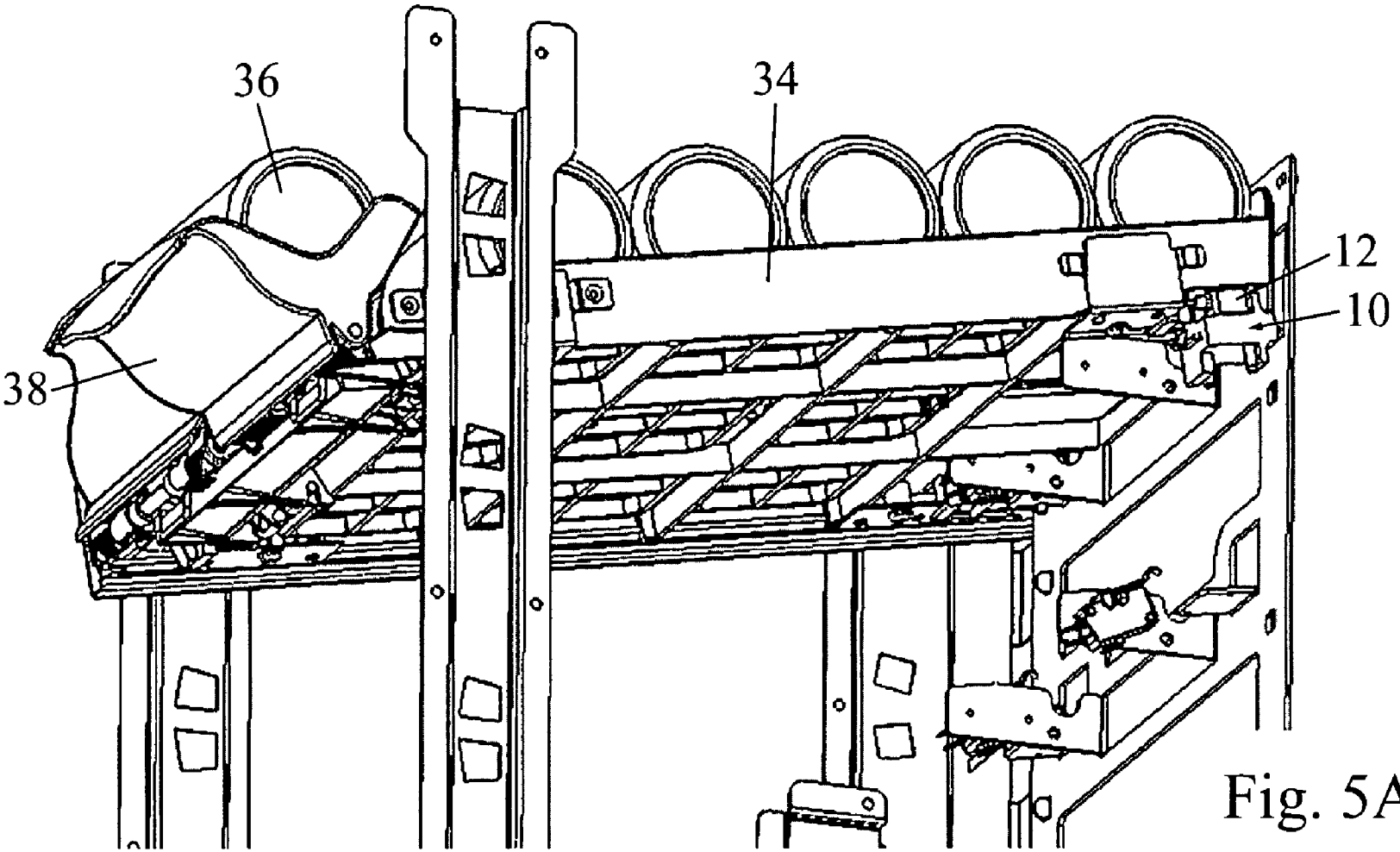
FIGS. 5A and 5B are simplified pictorial and close-up illustrations, respectively, of the merchandise tray in the vending machine, showing the dispensing door in the open position that causes a cap at the end of the push rod to actuate the sensor, in accordance with an embodiment of the present invention.
Figure 5B:
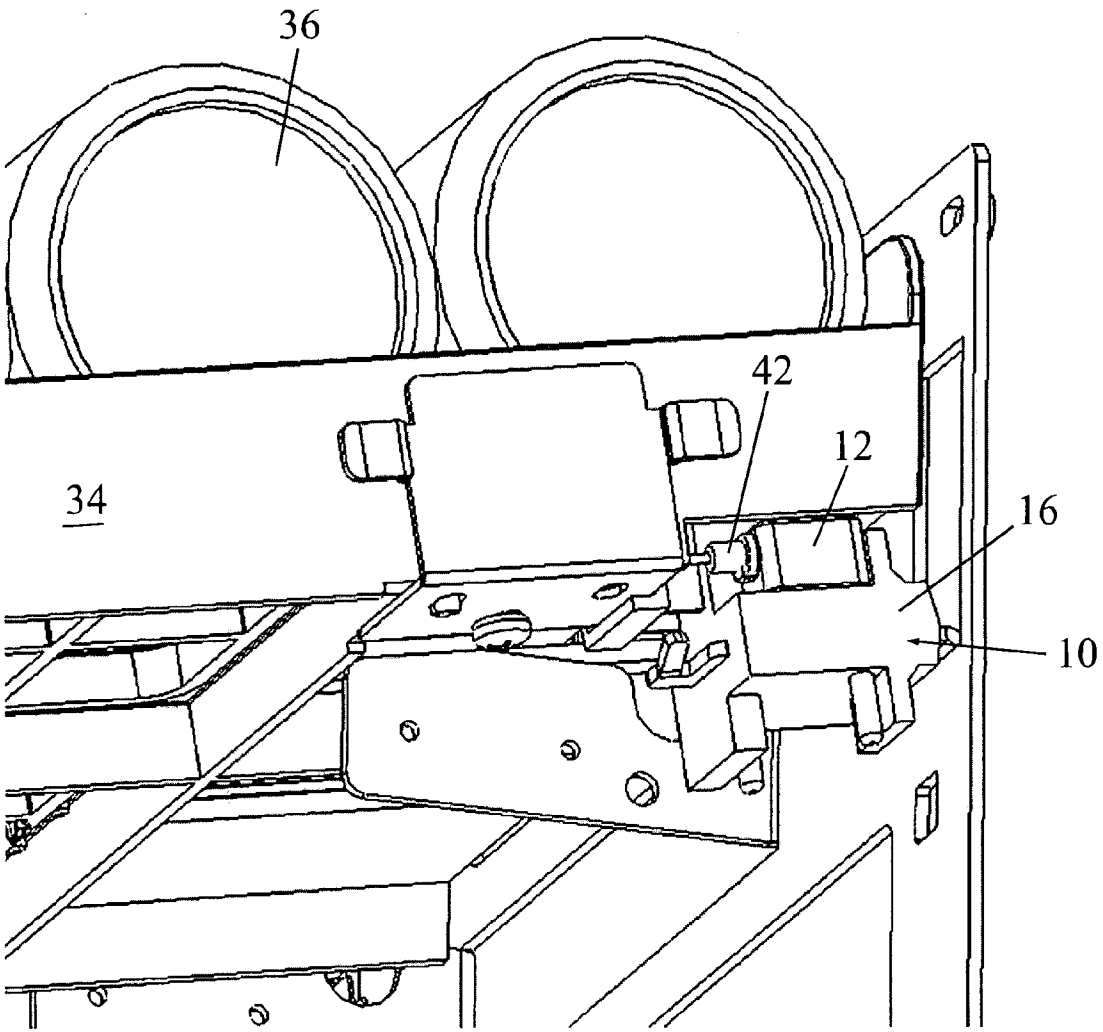

Reference is now made to FIGS. 3 and 4, which illustrate the merchandise tray 34 in more detail. Dispensing door 38 is connected to a push rod 40 at the end of which is a cap 42, also referred to as push rod cap 42 or sensor actuator 42 (also seen in FIG. 2B). By comparing FIGS. 3 and 4, it is seen that when dispensing door 38 is open by pivoting downwards in the direction of arrow 43 in FIG. 4, push rod 40 moves backwards in the direction of arrow 44 and causes push rod cap 42 to move backwards as well. As seen in FIGS. 5A and 5B, moving dispensing door 38 to the open position causes push rod cap 42 to actuate microswitch 12 by pushing against actuatable element 14 (not seen in FIG. 5B).

Figure 6:
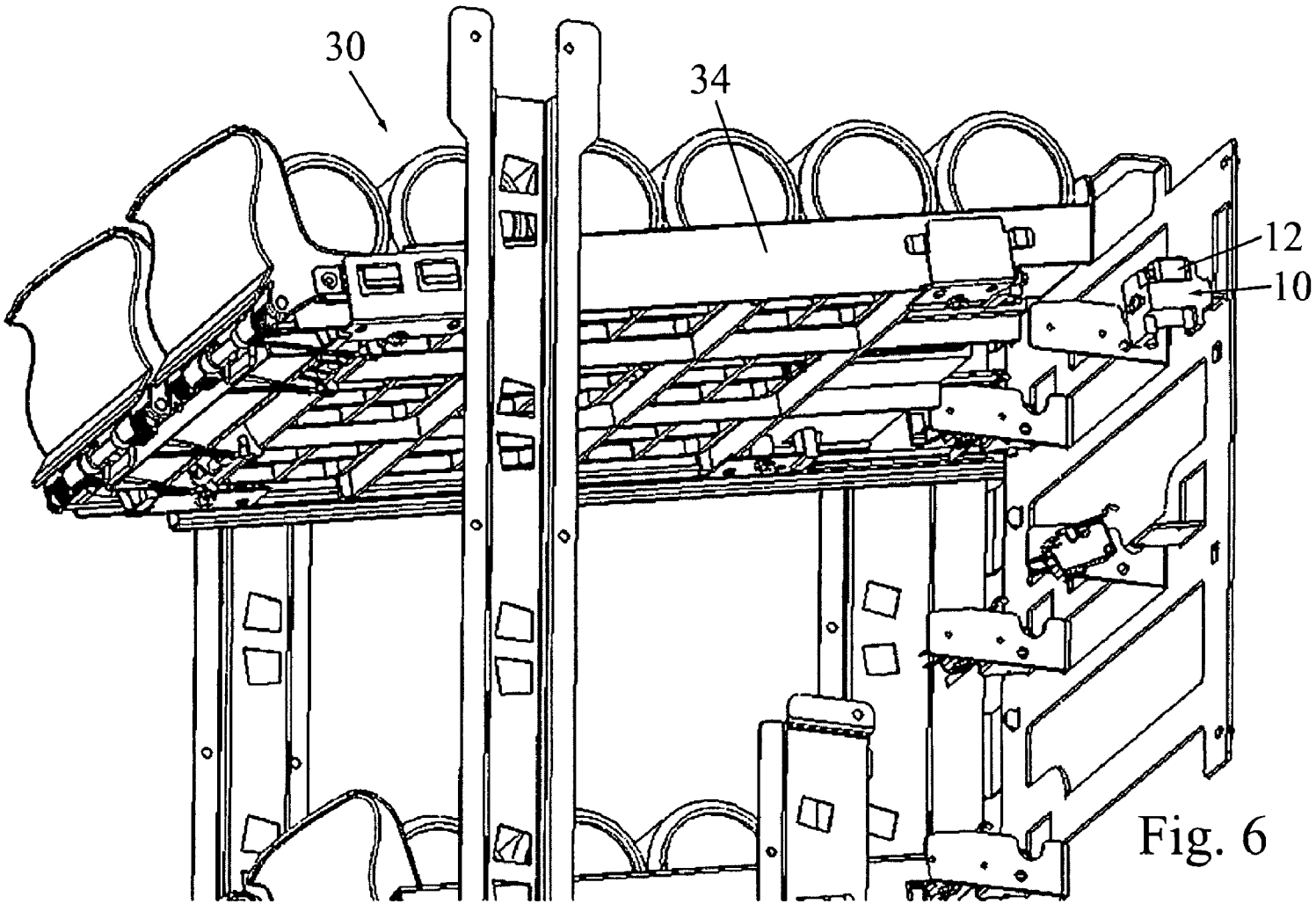
FIGS. 6 and 7 are simplified pictorial and close-up illustrations, respectively, of the tray of merchandise pulled open in the vending machine, such that the push rod cap is distanced from the sensor assembly, and the sensor assembly is biased forward by a biasing device.
Figure 7:
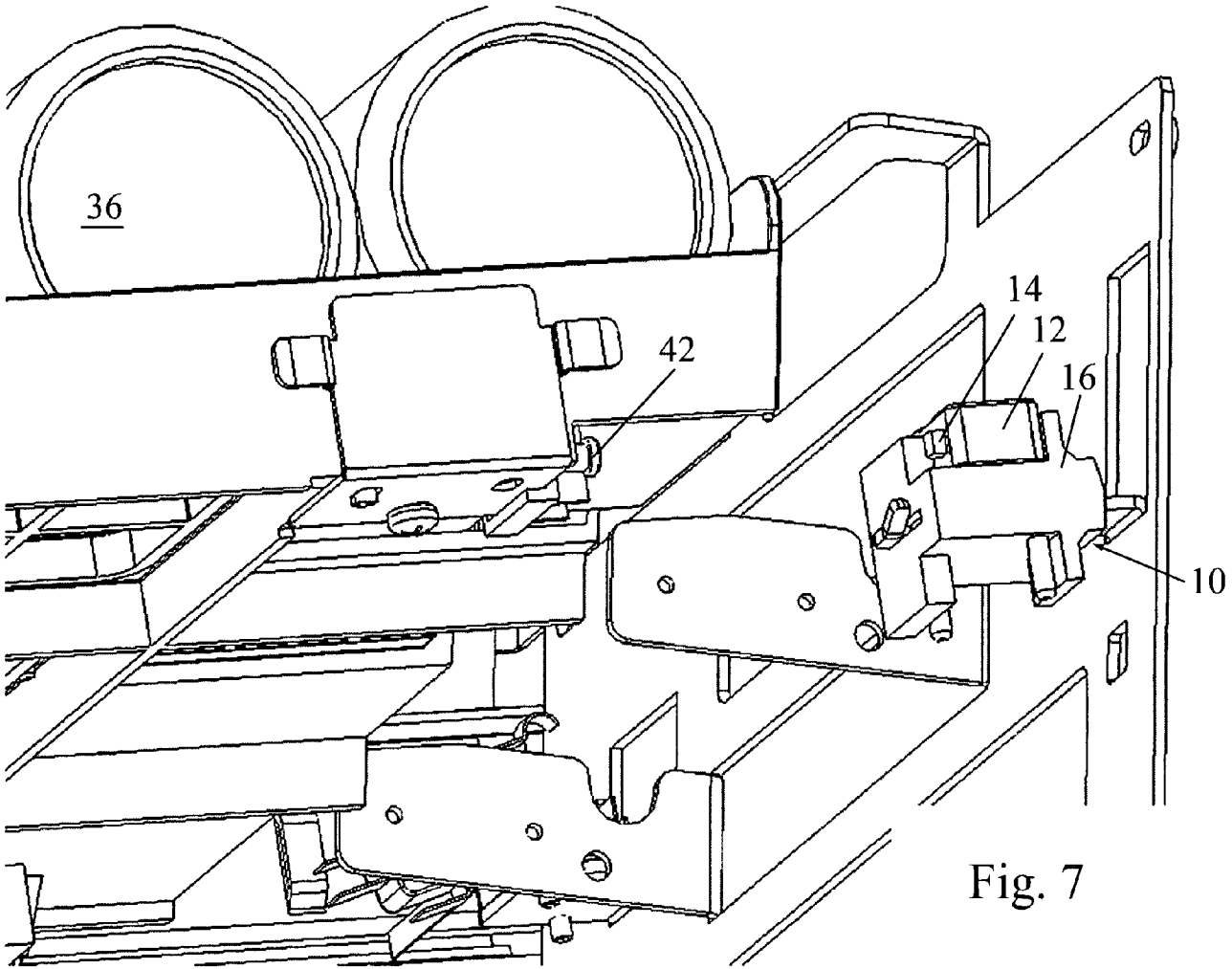

Reference is now made to FIGS. 6 and 7, which illustrate tray 34 pulled open in vending machine 30. The tray 34 is periodically opened, for example, to replenish the merchandise 36 in tray 34. In the open position of tray 34, push rod cap 42 is distanced from actuatable element 14 of the sensor assembly 10. It is noted that in this position, sensor assembly 10 is biased forward by biasing device 22 (not seen in FIG. 7).

Figure 8:
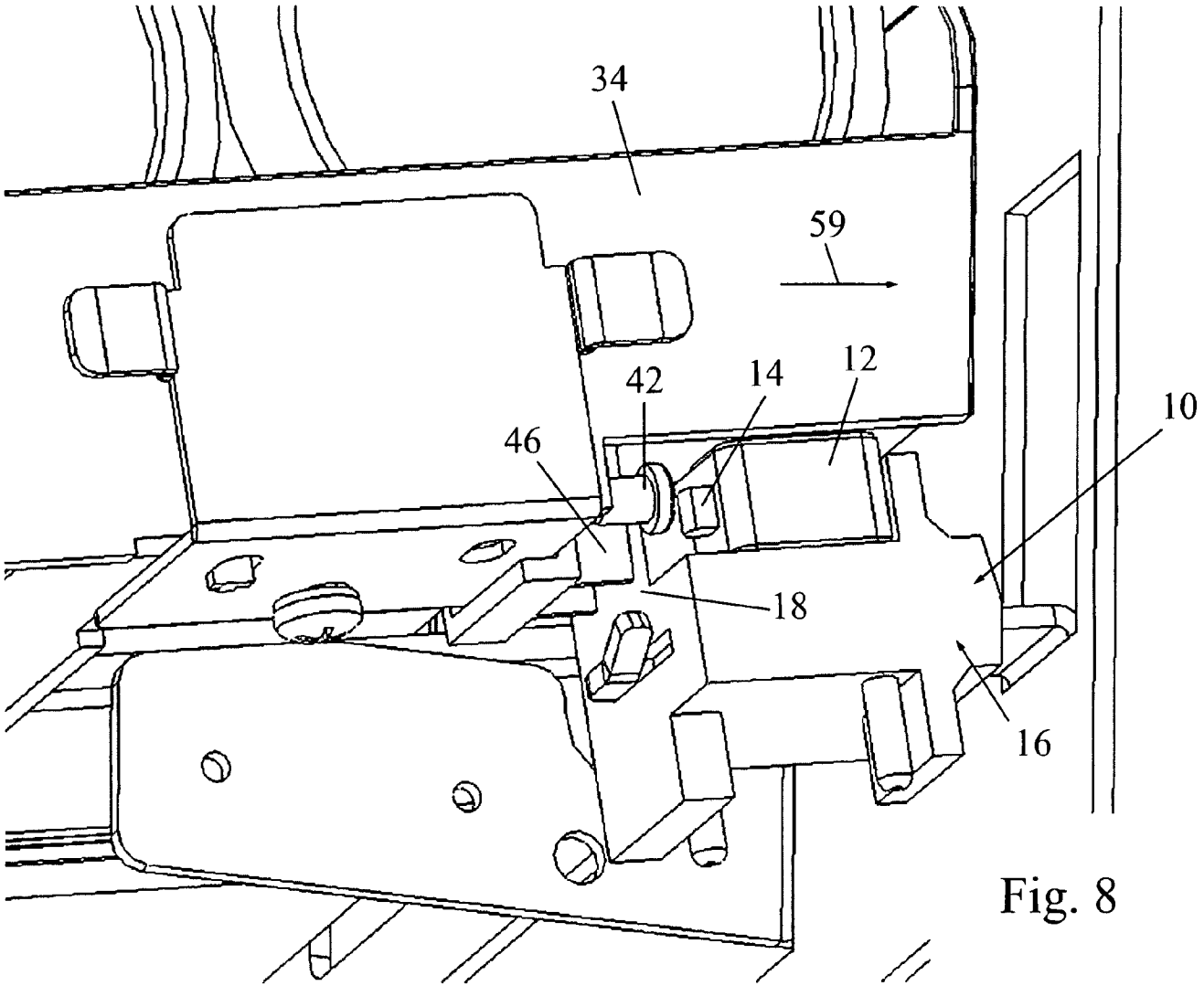
FIG. 8 is a simplified pictorial illustration of pushing the tray back towards the sensor assembly, wherein the tray ribs contact the holder of the sensor assembly.

Reference is now made to FIG. 8, which illustrates pushing tray 34 back towards sensor assembly 10 in the direction of arrow 59. At this point, tray ribs 46 (situated at the rear of tray 34) contact and abut against leading face 18 of holder 16 of sensor assembly 10. It is noted that leading face 18 thus protects microswitch 12 from the striking force of tray 34.

Figure 9:
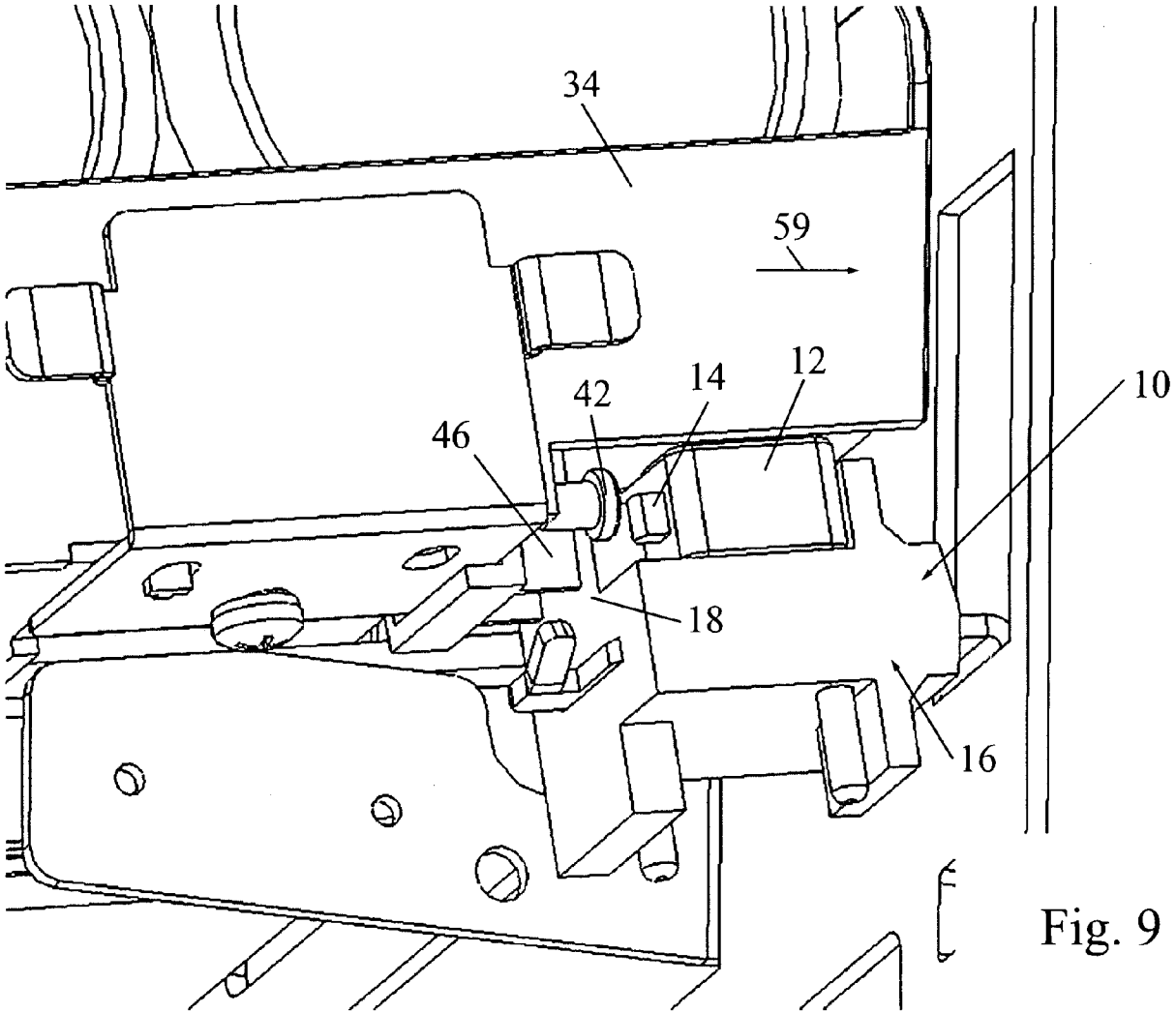
FIG. 9 is a simplified pictorial illustration of the tray being pushed further against the sensor assembly, wherein the tray ribs push the sensor assembly backwards.

Reference is now made to FIG. 9, which illustrates tray 34 being pushed further against sensor assembly 10 in the direction of arrow 59. At this point, tray ribs 46 push sensor assembly 10 backwards against the force of biasing device 22 (not seen in FIG. 9).

Figure 10:
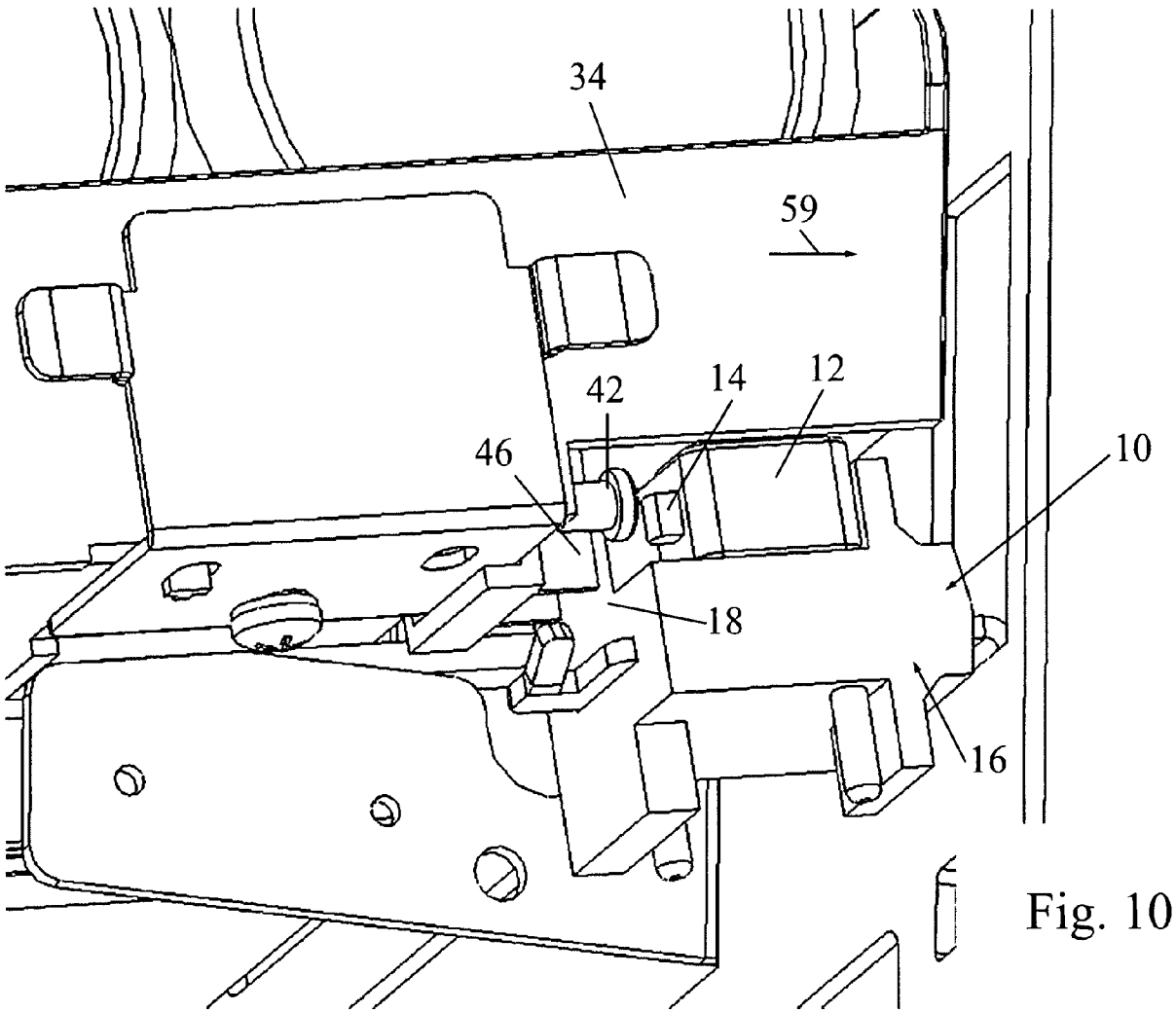
FIG. 10 is a simplified pictorial illustration of the tray closed against the sensor assembly, showing that the gap between the push rod cap and the sensor actuator element is constant no matter how many times the tray has been moved (pulled and pushed), in accordance with an embodiment of the present invention.

Reference is now made to FIG. 10, which illustrates tray 34 closed against sensor assembly 10 in what is referred to as an activating position for activating actuatable element 14. It is seen that the gap between push rod cap (sensor actuator) 42 and actuatable element 14 is constant no matter how many times tray 34 has been moved (pulled and pushed). Accordingly, actuatable element 14 is maintained substantially at the predetermined spatial position with respect to sensor actuator 42 for proper actuation. This eliminates any sensitivity to manufacturing tolerances. Only the opening movement of dispensing door 38 of tray 34 causes a billing to be recorded and thus eliminates false billing. The installment of sensor assembly 10 in vending machine 30 thus provides an accurate billing point. It is noted that tray 34 does not include any electrical wiring or components. Rather the sensor 12 is mounted external to tray 34 (on some part of the vending machine 30) and this greatly simplifies assembly of the vending machine 30.

It is noted that sensor assembly 10 may be installed in any other machinery and devices where it is desired to maintain a constant gap between the actuatable element 14 and the sensor actuator that contacts it (e.g., push rod cap 42), and thus eliminate any sensitivity to manufacturing tolerances and such.

The scope of the present invention includes both combinations and subcombinations of the features described hereinabove as well as modifications and variations thereof which would occur to a person of skill in the art upon reading the foregoing description and which are not in the prior art.

What is claimed is:

1. A vending machine comprising:

a tray comprising a dispensing door openable to dispense merchandise disposed in said tray, said dispensing door being connected to a sensor actuator;

a sensor comprising an actuatable element that causes an operation when actuated by said sensor actuator, said sensor comprising a holder; and a biasing device that imparts a biasing force against said holder that compensates for relative movement between said actuatable element and said sensor actuator so as to maintain said actuatable element substantially at a predetermined spatial position with respect to said sensor actuator, wherein when said tray is in an activating position, opening of said dispensing door causes said sensor actuator to actuate said actuatable element to cause said operation, and wherein said holder and said biasing device are mounted on a mounting bracket.

2. The vending machine according to claim 1, wherein said biasing device maintains a substantially constant gap between said actuatable element and said sensor actuator in said activating position.

3. The vending machine according to claim 1, wherein said holder is formed with a groove and a recess adjacent said groove, and wherein said biasing device is placed in said recess and said mounting bracket passes through said groove.

4. The vending machine according to claim 1, wherein said holder comprises a leading face that protects a portion of said sensor from impact applied against said leading face.

* * * * *